US005947326A

United States Patent [19]

O'Hern et al.

[11] Patent Number: 5,947,326

[45] Date of Patent: Sep. 7, 1999

[54] BUNG AND STOPPER

[75] Inventors: William John O'Hern, Tucson, Ariz.; Michael Patrick O'Hern, Atascadero; Wilbert E. Rojewski, San Mateo, both of Calif.

[73] Assignee: Alasco Rubber & Plastics Corporation, Belmont, Calif.

[21] Appl. No.: 08/967,813

[22] Filed: Nov. 12, 1997

[51] Int. Cl.[6] ..... B65D 43/04; B65D 39/16

[52] U.S. Cl. ..... 220/802; 16/2.3; 215/355; 220/601; 220/DIG. 19

[58] Field of Search ..... 220/DIG. 19, 802, 220/601; 217/98, 110, 113; 215/296, 305, 320, 355; 138/89, 921; 16/2.1, 2.2, 2.3

[56] References Cited

U.S. PATENT DOCUMENTS

| | | | |
|---|---|---|---|
| 280,344 | 7/1883 | Brady | 16/2.4 |
| 307,412 | 10/1884 | Rueter | 217/98 |
| 342,338 | 5/1886 | Deverall . | |
| 766,206 | 8/1904 | Westling | 217/110 |
| 1,491,911 | 4/1924 | Hussar . | |
| 2,303,359 | 12/1942 | Hothersall | 220/DIG. 19 |
| 2,577,780 | 12/1951 | Lockhart | 215/247 X |
| 3,405,832 | 10/1968 | Lukesech et al. | 215/355 |
| 3,468,450 | 9/1969 | Webel | 220/266 |
| 3,484,027 | 12/1969 | Micallef . | |
| 3,805,990 | 4/1974 | Palaudarias . | |
| 3,990,661 | 11/1976 | De Groef | 248/56 |
| 4,211,115 | 7/1980 | Engebreth . | |
| 4,708,157 | 11/1987 | Sabatino . | |
| 4,748,999 | 6/1988 | Delwiche . | |
| 4,809,871 | 3/1989 | Angelchick | 215/355 X |
| 4,842,869 | 6/1989 | Forino . | |
| 4,887,744 | 12/1989 | Williams . | |
| 4,932,543 | 6/1990 | Martus . | |
| 5,385,253 | 1/1995 | Scharf et al. | 215/296 |

FOREIGN PATENT DOCUMENTS

| | | | |
|---|---|---|---|
| 651173 | 3/1979 | U.S.S.R. | 138/89 |

*Primary Examiner*—Allan N. Shoap
*Assistant Examiner*—Joe Merek
*Attorney, Agent, or Firm*—Pennie & Edmonds LLP

[57] ABSTRACT

A bung comprises a deformable member with a generally cylindrical middle portion generally coinciding with the bunghole when inserted, and upper and lower frusto-conical ends which increase in diameter as each end extends from the middle portion. The middle portion is preferably of a size less than the hole to facilitate insertion of bung into and removal from the bunghole. Where the hole is tapered, the middle portion is similarly tapered. The spool-like shape of the stopper helps to prevent unintentional disengagement of the bung from the hole and to prevent overinsertion of the bung into the hole. The bung may further comprise one or more pull tabs to facilitate removal. The bung may define a bore to allow gas pressure to escape from the container, thus acting as a stopper. A rigid annular insert at the opening of the throughbore prevents deformation of the circular shape of the opening.

21 Claims, 2 Drawing Sheets

BUNG AND STOPPER

FIELD OF THE INVENTION

The present invention generally relates to a bung for sealing a container such as a wine barrel. The present invention also relates to a stopper which permits sealing of a container while also providing an opening for gas pressure to escape.

BACKGROUND OF THE INVENTION

For sealing a hole in a container such as a wine barrel, it is desirable to provide a bung which cannot be easily removed from the hole as a result of unintentional contact or as a result of increased pressures within the container, but which may be readily removed when it is desired to do so. The prior art has provided bungs where the surface contact area between the bung and the surface of the container defining the bunghole is relatively large. The arrangement of prior art bungs has typically resulted in a situation where a relatively small amount of force is required to disengage the bung from the hole, leading to accidental removal (e.g., knocking out) of the bung. Another disadvantage of such a prior art bungs is that conversely a relatively large amount of force is also required to insert and engage the bung with the hole, making insertion difficult.

It may also be desirable to provide an opening through the bung which allows the release of gases from the barrel while also preventing contaminants from entering into the container. Such bungs with pressure release openings are often referred to as stoppers. The prior art has provided various combinations of stoppers and plugs for this purpose.

However, prior art stoppers in such stopper-plug combinations have the same drawbacks as prior art bungs. Also, due to the shape of the barrel, stoppers made of materials such as rubber or silicone are irregularly distorted when inserted, resulting in the through-hole taking on an out-of-round shape. The out-of-roundness can prevent proper operation of the plug/valve used to prevent entry of contaminants.

Accordingly, there remains a need in the art for a bung or stopper which reduces the possibility of unintentional removal from the bunghole, while requiring a relatively small amount of force to be intentionally inserted into and removed. There is a further need for means to eliminate out-of-roundness in the through-hole of deformable stoppers.

SUMMARY OF THE INVENTION

The present invention meets the foregoing needs by providing a bung with a middle portion which approximately coincides with the bunghole when inserted in the hole, and upper and lower portions which flare out from the middle portion. The cross-section of middle portion is of a size slightly less than that of the cross-section of the bunghole to minimize frictional surface contact area and thus facilitate insertion of the bung into and removal of bung from the bunghole. The flaring out of the lower portion helps to prevent unintentional disengagement of the bung from the bunghole due to pressures within the container or to accidental contact with the bung. The flaring out of the upper portion from the middle portion helps to prevent overinsertion of the bung into the hole. The bung may also provide one or more pull tabs to facilitate removal of the stopper from the hole.

The bung of the present invention may be used as a stopper by providing a central throughbore to allow gases to escape from the barrel. To prevent deformation of the through-hole opening, a rigid annular insert is placed at the opening.

DETAILED DESCRIPTION OF THE INVENTION

Figure 1:
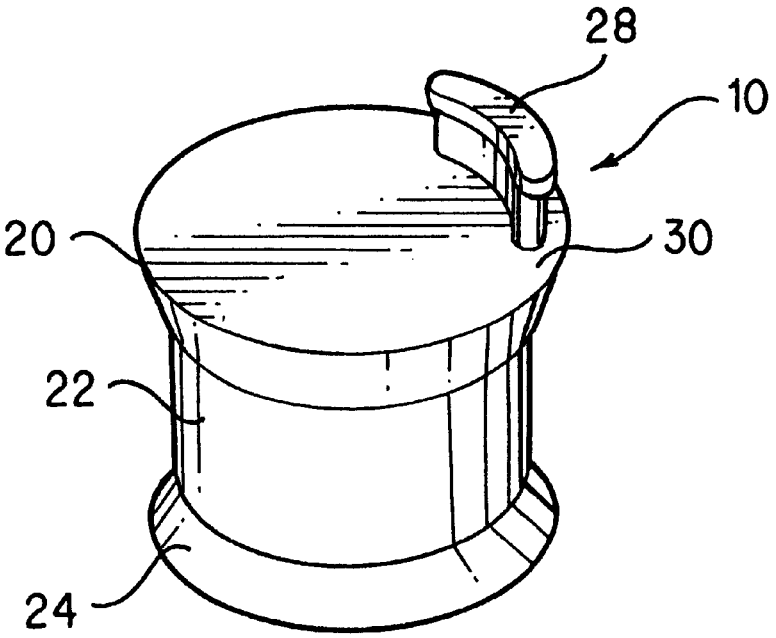
FIG. 1 shows a perspective view of an embodiment of a bung according to the present invention.

The structure and function of the preferred embodiments can best be understood by reference to the drawings. Where the same reference numerals appear in multiple figures, the numerals refer to the same or corresponding structure in those figures.

Figure 2:
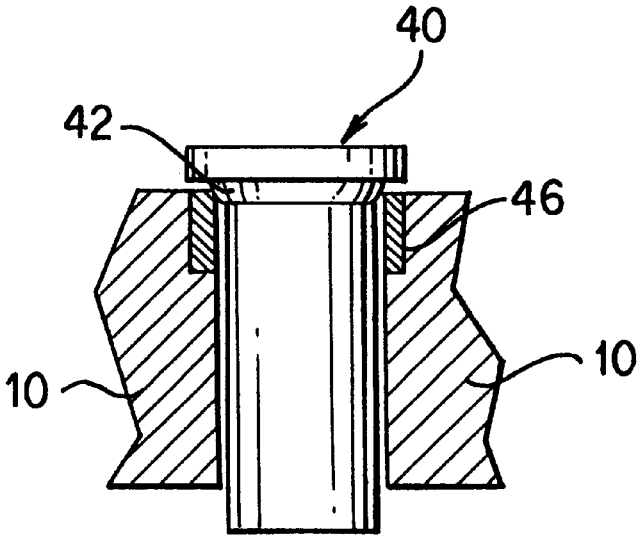
FIG. 2 shows a partial cross-sectional view of a stopper according to the present invention plug inserted into the stopper.
Figure 3:
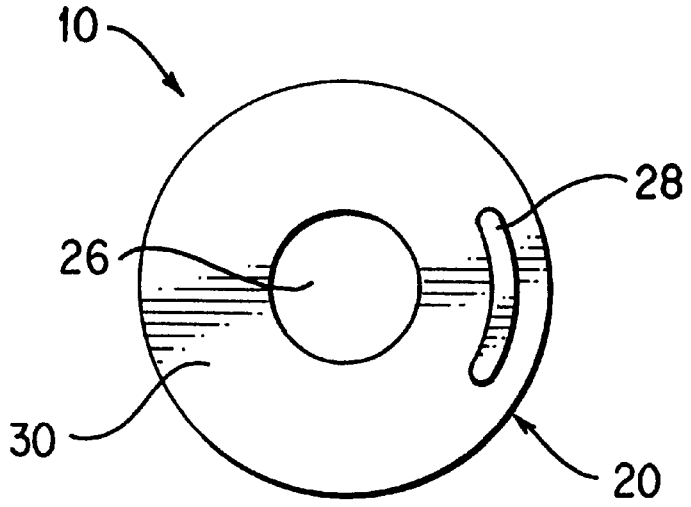
FIG. 3 shows a top view of a stopper of the present invention.
Figure 4:
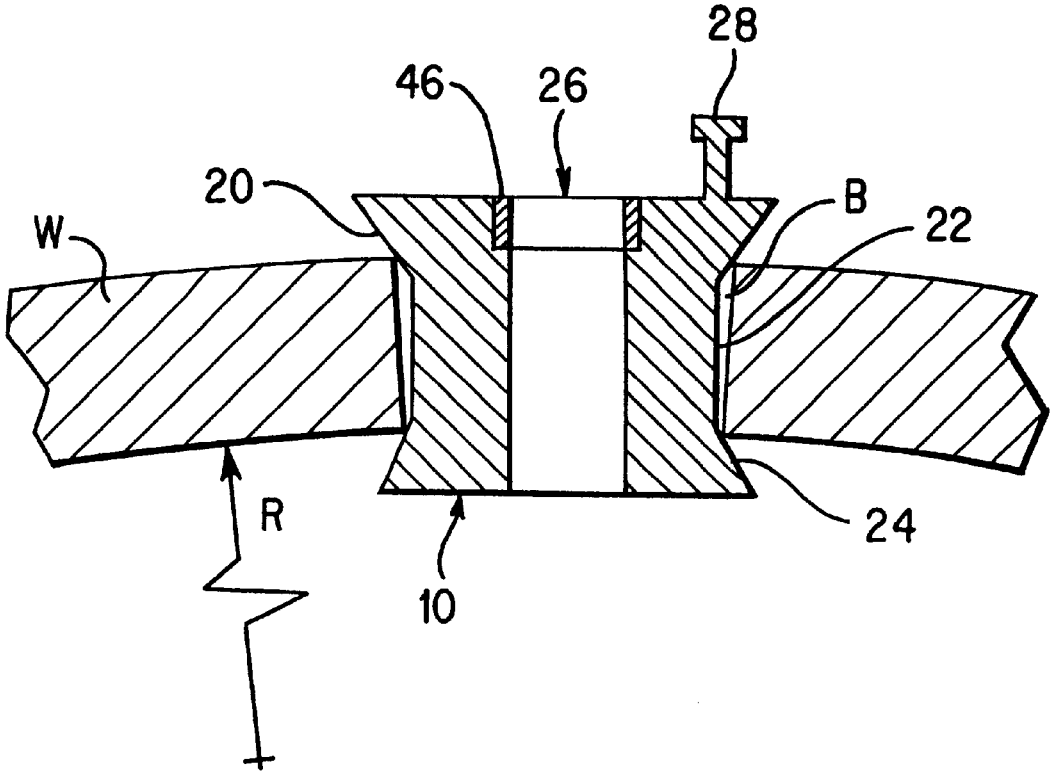
FIG. 4 shows a cross-sectional view of a stopper according to the invention inserted in a bunghole.

As shown in FIG. 1, bung 10 of the present invention is made of a deformable and incompressible material, for example silicone rubber, and generally comprises upper portion 20, middle portion 22 and lower portion 24. Bung 10 may be utilized as a stopper by providing central through-hole 26 as shown in FIGS. 2–4. As shown in FIG. 4, bung/stopper 10 is inserted into bunghole B defined by a container wall W.

At least a portion of the diameter of middle portion 22 is preferably slightly smaller than the diameter of the bunghole by, for example, approximately 0.050–0.001". The exact sizing determined by a person of ordinary skill based on permissible tolerances, actual wall thickness and hole diameter, among other factors. It is also preferred that no part of the middle portion be larger than the hole diameter. Having the diameter of middle portion 22 smaller than the diameter of the hole decreases the amount of contact surface area between bung/stopper 10 and the container wall defining the hole. Thus, the amount of force needed to insert bung/stopper 10 into the bunghole is thereby decreased. Where the bunghole B is tapered, middle portion 22 is preferably similarly shaped such that the amount of space between middle portion 22 and the edge of the bunghole is approximately uniform along the height of middle portion 22. For example, as is typical for wine fermentation barrels the bunghole B tapers such that diameter of hole is smallest at the interior of the barrel wall W.

Upper and lower portions 20, 24 are two opposed and outwardly extending frusto-conical end portions of bung/stopper 10. As each of upper and lower portions 20, 24 extends from middle portion, each portion increases to a diameter greater than diameter of bunghole B. Thus, bung/stopper 10 is of a spool-like shape. Such an increase in diameter of upper portion 20 facilitates in preventing over-insertion of stopper 10 into the bunghole. Similarly, such an increase in diameter of lower portion 24 facilitates in preventing unintentional disengagement of stopper 10 with bunghole B, for example, from accidental contact with stopper 10 or from increased gas pressure within the container as a result of a temperature increase and/or fermentation process.

As shown in FIG. 4, the length of middle portion 22 is preferably less than the thickness of container wall W such that upper portion 20 and lower portion 24 partially reside within the bunghole. Thus, the corners of the hole deform parts of upper and lower portions 20, 24 in contact with the container wall. Alternatively, the bunghole is sealed by having only upper portion 20 or only lower portion 24 partially reside within hole 26.

By way of example, a typical wine barrel bunghole has a wall thickness of approximately 0.900" and an outside diameter of approximately 1.980" tapering to an interior diameter of approximately 1.850". For use with the typical bunghole, middle portion 22 of bung 10 would preferably have a diameter of approximately 1.885" tapered to approximately 1.850" over a thickness of approximately 0.460". Each of upper and lower portions 20, 24 would be preferably approximately 0.270" in thickness. The diameter of the outside end of the bung would be approximately 2.210" and the diameter of the inside end approximately 1.920" in this example.

To facilitate removal of bung/stopper 10 from the bunghole, one or more pull tabs 28, preferably near an edge of top surface 30 of upper portion 20, may be provided. Locating pull tab 28 near an edge of top surface 30 facilitates deformation of upper and lower portions 20, 24 and thus facilitates removal of bung/stopper 10 from the hole.

To allow gas pressure to escape from a barrel such as during fermentation of wine, stopper 10 may define a central bore 34. In order to prevent contaminants from entering into the barrel throughbore 34 a plug 40 is often used.

As illustrated in FIG. 2, plug 40 includes a spherical portion 42 to facilitate creating a complete seal with the central bore 26 through the stopper. However, when stoppers are made of a deformable material, such as various forms of rubber, the shape of throughbore 26 may be deformed to a slightly non-circular shape due to a variety of reasons such as irregularities in the bunghole and the varying curvatures of a typical barrel. In particular, because a wine barrel is not a straight cylindrical shape, the wall of the barrel has a compound curvature. From side to side, the barrel is circular having a first radius, e.g. R as in FIG. 4. From top to bottom, the wall of the wine barrel is also bowed and has a second radius which is typically much larger than the first radius. The second radius would define a curvature perpendicular to the curvature of wall W shown in FIG. 4. Because of these compound curvatures, the bunghole in the wooden wine barrel can exert irregular forces on the bung plug or stopper. In the case of a stopper, the irregular forces may deform the throughbore. If the opening of throughbore 26 is not circular, then the plug, e.g. plug 40, may not properly seal with the stopper. In order to void or lessen this problem, stopper 10 preferably may be provided with a relatively rigid insert 46, as shown in FIG. 4. Insert 46 is a ring of rigid material such as metal or rigid plastic that has an inner diameter which approximately matches the inner diameter of central throughbore 26. Insert 46 is inserted into central throughbore 26 at the outer opening of the bore on the top of the stopper. In this manner, if irregular forces are exerted on stopper 10 in use, rigid insert 46 resists defamation of the opening of bore 26 so as to permit a good seal by a plug placed therein.

The present invention has been described in terms of preferred embodiments. The invention, however, is not limited to the embodiment depicted and described. Rather, the scope of the invention is defined by the appended claims.

What is claimed is:

1. A bung for sealing a hole in a container, comprising a deformable and resilient member having a middle portion with generally circular ends and a side wall having at least a first diameter and a length; a first end portion flaring outward from the middle portion to a second diameter; and a second end portion, opposite the first end portion, flaring outward from the middle portion to a third diameter; wherein said first diameter at any point along said length of said side wall is less than said second diameter and said third diameter.

2. The bung according to claim 1, wherein said first end portion and said second end portion have a frusto-conical shape.

3. The bung according to claim 1, wherein said second diameter is greater than the third diameter.

4. The bung according to claim 1, wherein said bung is sized relative to a hole in a container such that the diameter of at least part of the middle portion is less than the hole diameter and said middle portion length is less than the hole depth.

5. The bung according to claim 4, wherein the middle portion is tapered from a larger diameter adjacent the first end portion to a smaller diameter adjacent the second end portion.

6. The bung according to claim 5, wherein the middle portion has a diameter that tapers from about 1.885 inches to about 1.85 inches and a length of about 0.45–0.50 inches.

7. The bung according to claim 6, wherein the first and second end portions have an axial thickness of about at least one-quarter inch.

8. The bung according to claim 1, wherein the deformable member includes at least one pull tab disposed on the first end portion.

9. The bung according to claim 1, wherein the deformable member defines a central bore through the first and second ends and the middle portion.

10. The bung according to claim 9, further comprising an at least substantially rigid annular insert disposed in the throughbore at its opening on the first end portion.

11. The bung according to claim 1, wherein the deformable member is made of rubber.

12. The bung having a large diameter end and a small diameter end according to claim 11, wherein the bung is made of silicone rubber.

13. A bung for sealing a bunghole, comprising:

a resilient outer frusto-conical portion having a large diameter end and a small diameter end;

a middle portion with generally circular ends and a sidewall having a length; and an inner frusto-conical portion;

wherein the small diameter end of the outer portion joins the middle portion and the small diameter end of the inner portion joins the middle portion opposite the outer portion.

14. The bung according to claim 13, wherein the middle portion is tapered from a larger diameter adjacent the outer portion to a smaller diameter adjacent the inner portion.

15. The bung according to claim 14, wherein said bung is sized relative to a bunghole in a container such that said middle portion diameter is less than the bunghole diameter and said middle portion length is less than the bunghole depth.

16. The bung according to claim 13, further comprising at least one pull tab disposed on the outer portion.

17. The bung according to claim 13, wherein said bung is made of a deformable material.

18. The bung according to claim 17, including a throughhole opening on the outer portion and extending through said outer, middle and inner portions, said bung further comprising an at least substantially rigid annular insert disposed in said through-hole opening.

19. A bung, sized to match a bunghole which has a outer diameter, inner diameter and depth, said bung comprising, a deformable and resilient member having:

a tapered outer portion, tapering from a diameter larger than the bunghole outer diameter to a diameter smaller than the bunghole diameter;

a middle portion having generally circular ends and extending from the outer portion smaller diameter, said middle portion having a sidewall with a length less than the bunghole depth and a diameter smaller than the bunghole outer diameter; and a tapered inner portion extending from the middle portion opposite the outer portion and tapering from a diameter approximately equal to or less than the bunghole inner diameter to a diameter larger than the bunghole inner diameter.

20. The bung according to claim 19, wherein said outer portion smaller diameter at least approximately equals said diameter approximately equal to or less than the bunghole inner diameter of said inner portion.

21. The bung according to claim 19, wherein said bung middle portion is slightly tapered from a larger diameter adjoining the outer portion to a smaller diameter joining the inner portion such that the bung is sized to match a tapered bunghole.

* * * * *